US008556639B2

(12) United States Patent
Ueyama

(10) Patent No.: US 8,556,639 B2
(45) Date of Patent: Oct. 15, 2013

(54) ELECTRIC CONTACT AND SOCKET FOR ELECTRICAL PARTS

(75) Inventor: Yuki Ueyama, Saitama (JP)

(73) Assignee: Enplas Corporation, Saitama (JP)

( * ) Notice: Subject to any disclaimer, the term of this patent is extended or adjusted under 35 U.S.C. 154(b) by 93 days.

(21) Appl. No.: 13/292,159

(22) Filed: Nov. 9, 2011

(65) Prior Publication Data

US 2012/0129364 A1 May 24, 2012

(30) Foreign Application Priority Data

Nov. 18, 2010 (JP) ..... 2010-257976

(51) Int. Cl.
*H01R 12/00* (2006.01)

(52) U.S. Cl.
USPC ..... 439/66; 439/700

(58) Field of Classification Search
USPC ..... 439/66, 74, 482, 700, 824
See application file for complete search history.

(56) References Cited

U.S. PATENT DOCUMENTS 4,105,280 A * 8/1978 Thompson, Jr. ..... 439/820
4,636,026 A * 1/1987 Cooney et al. ..... 439/482
6,159,056 A * 12/2000 Boyle ..... 439/700
7,381,062 B2 * 6/2008 Shimada ..... 439/66

FOREIGN PATENT DOCUMENTS

JP 2010-91436 4/2010

* cited by examiner

*Primary Examiner* — Khiem Nguyen
(74) *Attorney, Agent, or Firm* — Staas & Halsey LLP

(57) ABSTRACT

An electric contact which can improve the connection stability without increasing the sliding resistance even when the amount of reduction in the lengths of the electric contact is little. A preferred embodiment of the present invention comprises a first plunger which has conductivity and has an external cylinder portion; a second plunger which has internal contact portion to be inserted into the external cylinder portion, is interlinked with the first plunger in an extensible manner and has conductivity; and a coil spring which urges the first and second plungers toward a direction to separate them. The internal contact portion has a taper shape which expands towards the lower end from the upper end, and is formed so as to contact with the internal surface of the external cylinder portion and conduct to the external cylinder portion.

8 Claims, 9 Drawing Sheets

ELECTRIC CONTACT AND SOCKET FOR ELECTRICAL PARTS

BACKGROUND OF THE INVENTION

1. Field of the Invention

The present invention relates to an electric contact that is connected to an electrical part such as a semiconductor device (hereinafter, called an "IC package"), and related to a socket for electrical parts onto which the electric contact is located.

2. Description of the Prior Art

Conventionally, the IC socket, which accommodates the IC package as an "electrical part" removably, is known as the above-mentioned "socket for an electrical part".

The conventional IC package comprises a package body which has a rectangular shape, for example, and has terminals.

On the other hand, the conventional IC socket comprises socket body to be located on the wiring substrate. The socket body is provided with a contact pin unit comprising a plurality of contact pins for electrically connecting the terminals of the IC package and the wiring substrate.

In addition, the socket body comprises a floating plate located so as to be vertically movable under the state of being urged upward by springs, and the IC package is accommodated on the floating plate.

When the IC socket is located on the wiring substrate and is used, the floating plate accommodates the IC package on itself and moves downward by being pressed from above.

Then, the upper side contact portions of the contact pins are pressed to the terminals of the IC package via the through holes formed in the floating plate, while the lower contact portions of the contact pins are pressed to the electrodes of the wiring substrate.

Under such situation, the electrical currents flow between the wiring substrate and the IC package through the contact pins, and a burn-in test etc. is performed.

As such contact pins, an electrical contact, in which a cylindrical first plunger (i.e. barrel) and a rod-shaped second plunger (i.e. plunger) is interlinked in an extensible manner via an urging member (i.e. spring), has been proposed (see Japanese laid-open patent publication 2010-91436).

SUMMARY OF THE INVENTION

An object of the present invention is to provide an electric contact and a socket for electrical part in which the connection stability can be enhanced without increasing the sliding resistance even when the amount of reduction is small.

The first aspect of the present invention relates to an electric contact comprising; a first contact member which has conductivity and has an external cylinder portion; a second contact member which has internal contact portion to be inserted into the external cylinder portion, is interlinked with the first contact member in an extensible manner and has conductivity; and an urging member which urges the first contact member and the second contact member toward a direction to separate the first contact member and the second contact member; wherein the internal contact portion has a taper shape which expands from an end of being inserted into the first contact member toward the other end, and is formed so as to contact with the internal surface of the external cylinder portion and conduct to the external cylinder portion.

In the first aspect of the present invention, it is preferable that the urging member is a coil spring located inside of the external cylinder portion in an extensible manner, and one end of the coil spring is contacted to one end of the internal contact portion.

In the first aspect of the present invention, it is preferable that the first contact member comprises a first contact portion, an inner diameter of which is shorter than a diameter of the coil spring.

In the first aspect of the present invention, it is preferable that the other end of the coil spring is contacted to a step portion formed at a connection portion between the external cylinder portion and the first contact portion.

The second aspect of the present invention relates to a socket for an electrical part comprising: a socket body which is located on a wiring substrate and accommodates an electrical part on an upper side thereof, plural electric contacts which are located in the socket body, wherein the electric contact comprises; a first contact member which has conductivity and has an external cylinder portion, a second contact member which has internal contact portion to be inserted into the external cylinder portion, is interlinked with the first contact member in an extensible manner and has conductivity, and an urging member which urges the first contact member and the second contact member toward a direction to separate the first contact member and the second contact member, wherein the electric contact contacts to the electrical part at one of the first and second contact members, and contacts to the wiring substrate at the other of the first and second contact members, and wherein the internal contact portion has a taper shape which expands from an end of being inserted into the first contact member toward the other end, and is formed so as to contact with the internal surface of the external cylinder portion and conduct to the internal surface of the external cylinder portion.

In the second aspect of the present invention, it is preferable that the urging member is a coil spring located inside of the external cylinder portion in an extensible manner, and one end of the coil spring is contacted to one end of the internal contact portion.

In the second aspect of the present invention, it is preferable that the first contact member comprises a first contact portion, an inner diameter of which is shorter than a diameter of the coil spring.

In the second aspect of the present invention, it is preferable that the other end of the coil spring is contacted to a step portion formed at a connection portion between the external cylinder portion and the first contact portion.

According to the first and second aspects of the present invention, the connection stability can be enhanced without increasing the sliding resistance even when the amount of reduction in the lengths of the electric contact is small, because the internal contact portion, which is inserted into the external cylinder portion of the first contact member, has the taper shape.

According to the other characteristics of the first and second aspects of the present invention, a coil spring of simple structures can be used as the urging members, because any special structures of the urging member are not required.

BRIEF DESCRIPTION OF THE DRAWINGS

Other objects and purposes of the present invention are described with referencing the following attached drawings.

DETAILED DESCRIPTION

A Comparative Example

FIGS. 8A to 9B show a comparative example for making easier to understand the electrical contact according to the present invention.

The electrical contact shown in FIGS. 8A to 9B has following problems because the shape of the second plunger is a rod, that is, straight.

Figure 8C:
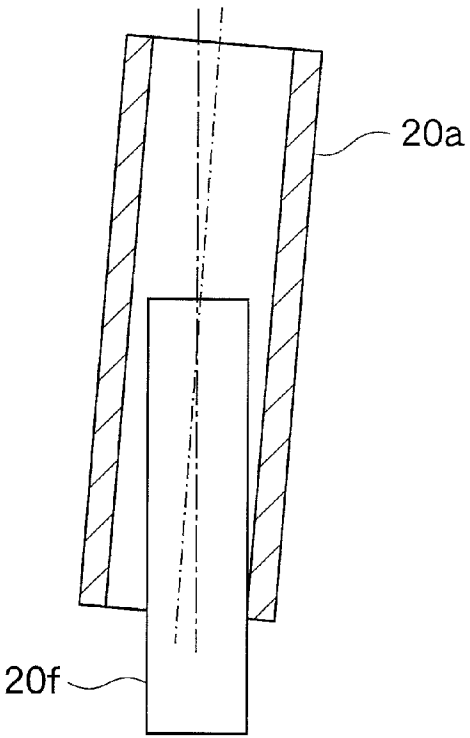
FIGS. 8A to 8C are cross-section pattern diagrams showing a conduction of the contact pin according to a comparative example.
Figure 8B:
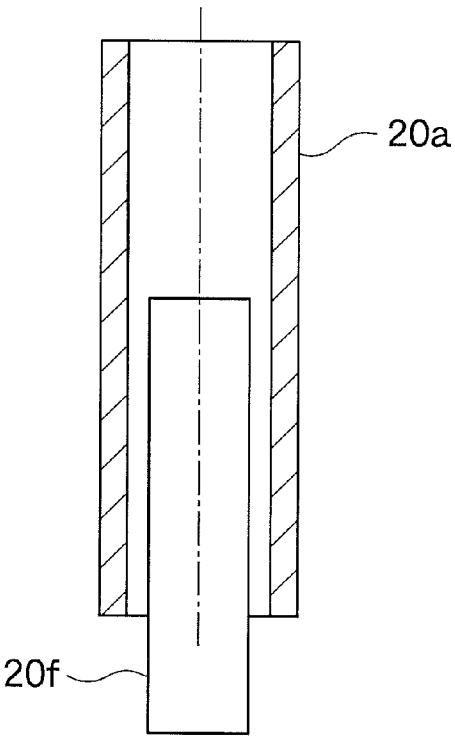
Figure 8A:
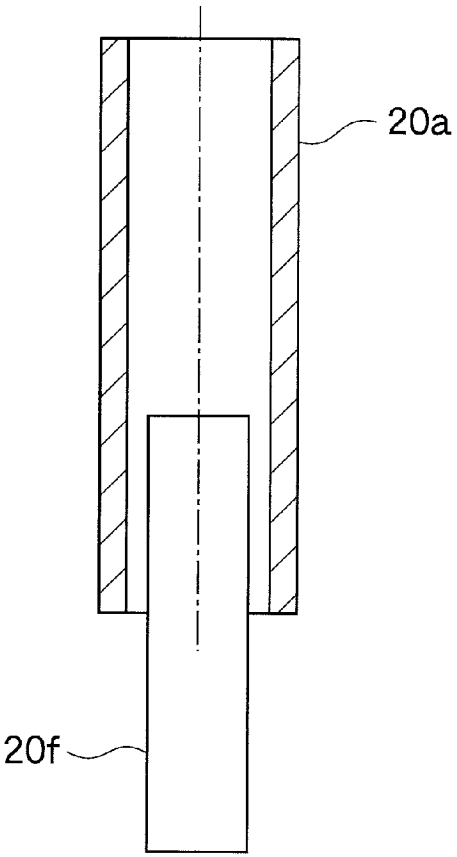

Firstly, as shown in FIGS. 8A and 8B, the first plunger 20*a* and the second plunger 20*f* do not stably contact each other if the plungers 20*a* and 20*f* are positioned on the same axis and the amount of reduction in the length of the electrical contact is too small. Therefore, the second plunger 20*f* needs to be inclined against the first plunger 20*a* to ensure the connection stability between them (see FIG. 8C). However, if the inclination of the second plunger 20*f* against the first plunger 20*a* becomes larger, the sliding resistance becomes larger and so the movement of the electric contact become weighted, consequently, the elastic force of the spring are being used wastefully.

Otherwise, it is presumable to make the diameter of the straight shape second plunger 20*f* larger for approximating the second plunger 20*a* to the inner surface of the first plunger 20*a* as much as possible, so that the inclination of the second plunger 20*f* against the first plunger 20*a* becomes smaller while ensuring the connection stability between the first plunger 20*a* and the second plunger 20*f*. However, such structure causes an increase of the frictional force between the first plunger 20*a* and the second plunger 20*f*, and so causes peelings of the plating of the first and second plungers 20*a* and 20*f*. In addition, the increase of the frictional force causes an increase in the sliding resistance and an increase in the weight of movement of the electrical contact. Consequently, such structure has no practical use.

Figure 9B:
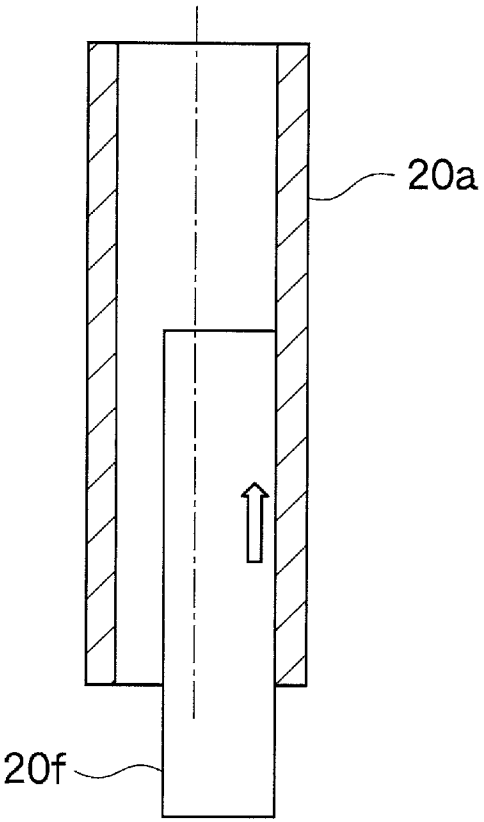
FIGS. 9A and 9B are cross-section pattern diagrams showing a stroke of the contact pin according to a comparative example.
Figure 9A:
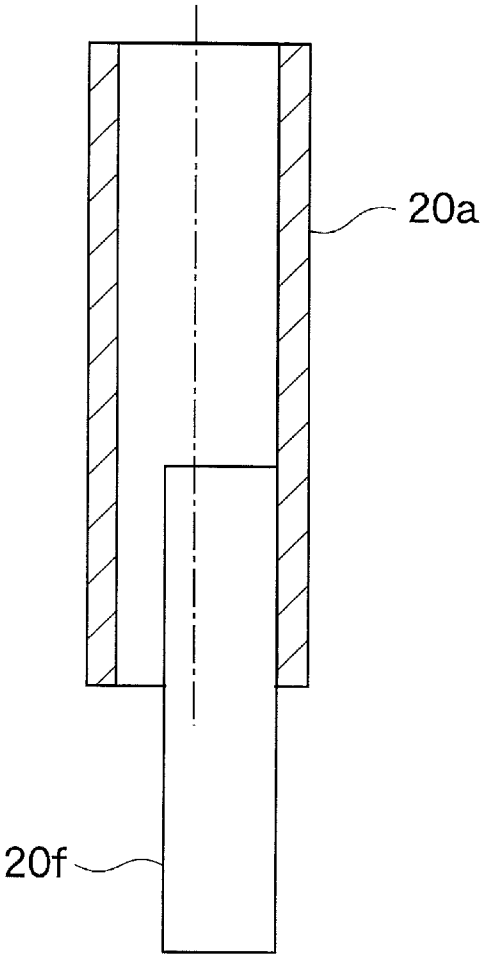

As shown in FIG. 9A and 9B, if the second plunger 20*f* moves in parallel fashion to the first plunger 20*a* and contacts it (see FIG. 9A), the horizontal load between the first and second plunger 20*a* and 20*f* rarely occurs when the second plunger 20*f* is inserted into the first plunger 20*a* (see FIG. 9B), and so the connection stability between the first and second plungers 20*a* and 20*f* is poor.

An Embodiment of the Invention

A preferred embodiment of the present invention is described hereinafter.

FIGS. 1 to 7B show the embodiment of the present invention.

Figure 1:
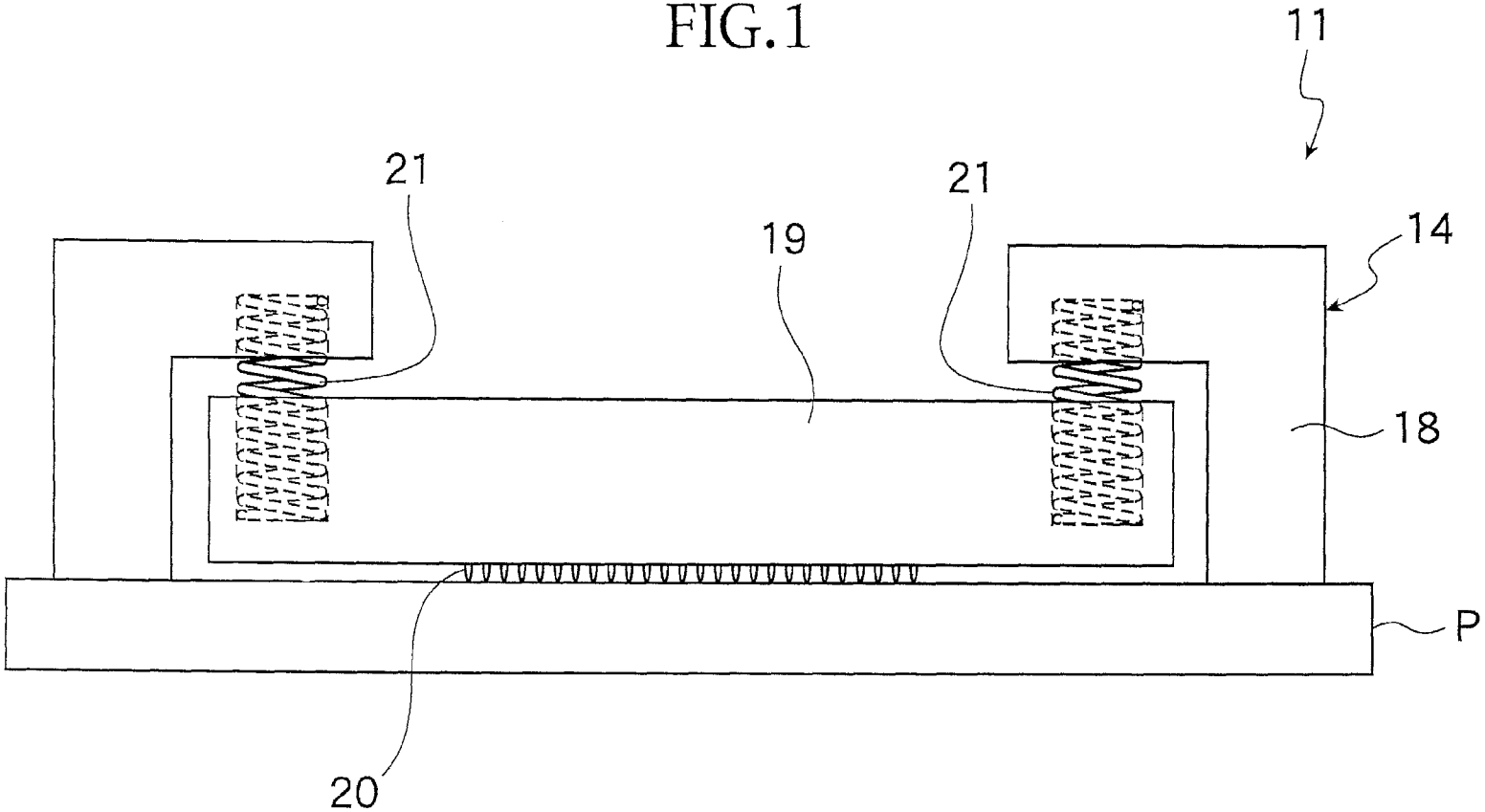
FIG. 1 is an elevation view showing the IC socket according to an embodiment of the present invention.

Firstly, the constitution of the present embodiment is described. In FIG. 1, the symbol 11 corresponds to the IC socket as "socket for electrical part". The IC socket 11 is located on the wiring substrate P. The spherical terminals 12*a* of the IC package 12 and the wiring substrate P are electrically connected for performing the burn-in test etc. of the IC package 12 (see FIG. 5) as "electrical part".

As shown in FIG. 1, the IC socket 11 comprises the socket body 14 which is fixed on the wiring substrate P and accommodates the IC package 12.

In detail, the socket body 14 comprises the external frame 18 of rectangular frame shape in which the contact module 19 is located, and the springs 21 located between the external frame 18 and the contact module 19.

Figure 4:
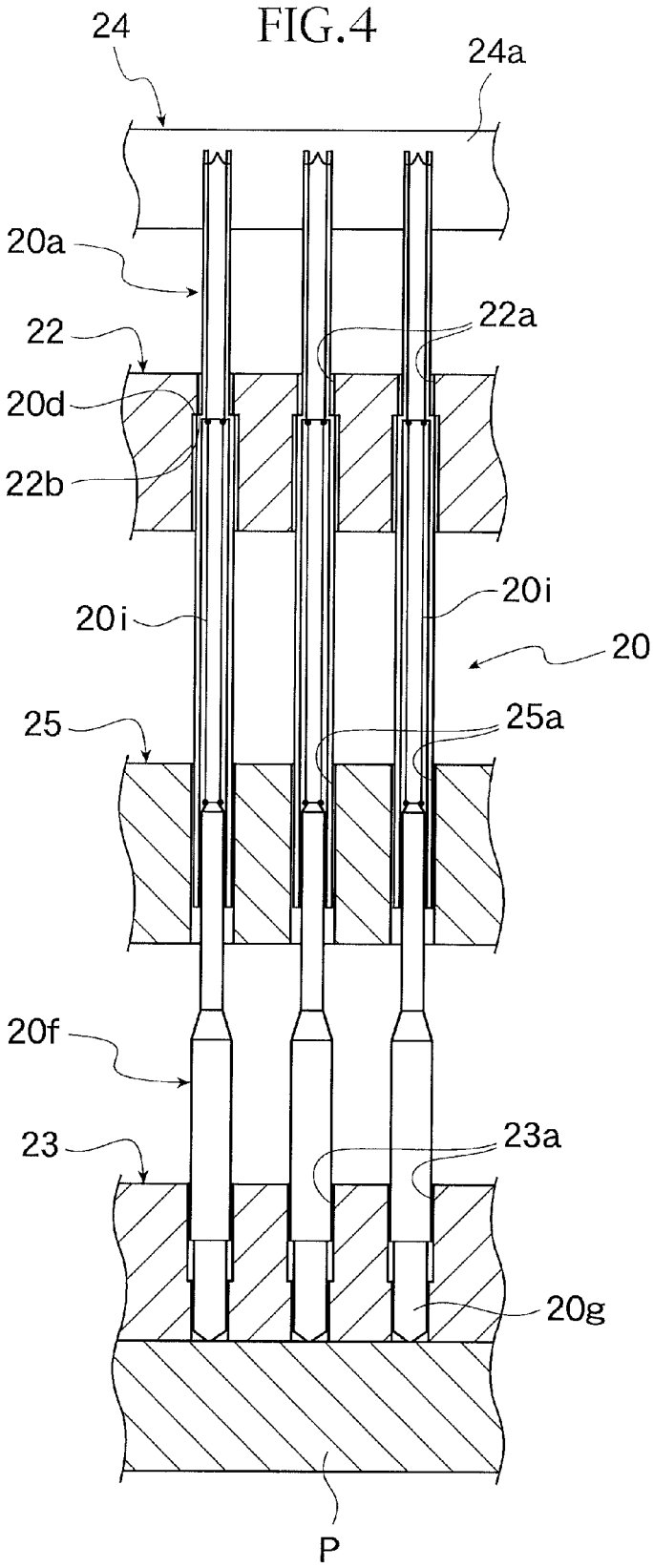
FIG. 4 is a cross-section view showing a state that the IC socket is mounted on the wiring substrate to give an explanation on how to use the IC socket according to the same embodiment.

In the contact module 19, plural contact pins 20 as the "electrical contact" are provided. The IC package 12 is accommodated on the upper side of the contact module 19. As shown in FIG. 4, the contact module 19 comprises the upper side holding member 22, the middle holding member 25, the lower side holding member 23, the floating plate 24 and so on. The upper side holding member 22, the middle holding member 25 and the lower side holding member 23 are held at predetermined intervals. The floating plate 24 is located above the upper side holding member 22 and is urged upward by the springs not shown in FIG. 4. And the contact pins 20 are located under the state of being inserted into the through holes 22*a*, 25*a*, 23*a* and 24*a* of the upper side holding member 22, the middle holding member 25, the lower side holding member 23 and the floating plate 24.

Figure 2A:
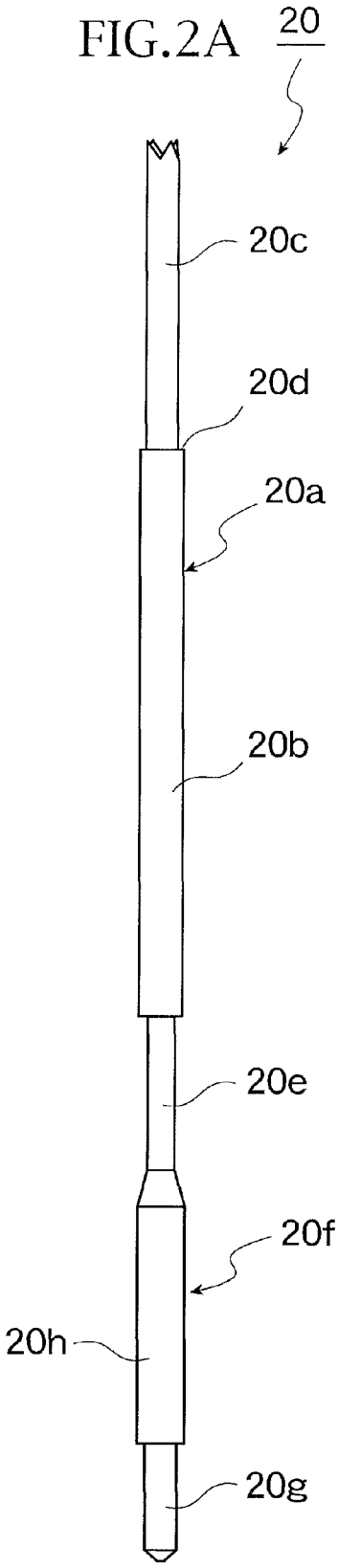
FIG. 2A is an elevation view showing the contact pin before being stroked according to the same embodiment.
Figure 2B:
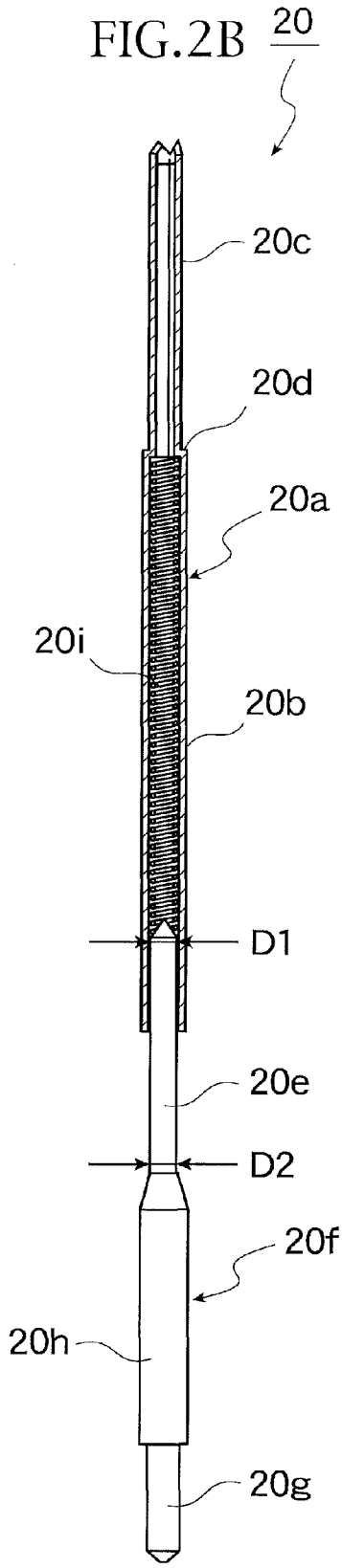
FIG. 2B is a cross-section view showing the contact pin before being stroked according to the same embodiment.
Figure 3A:
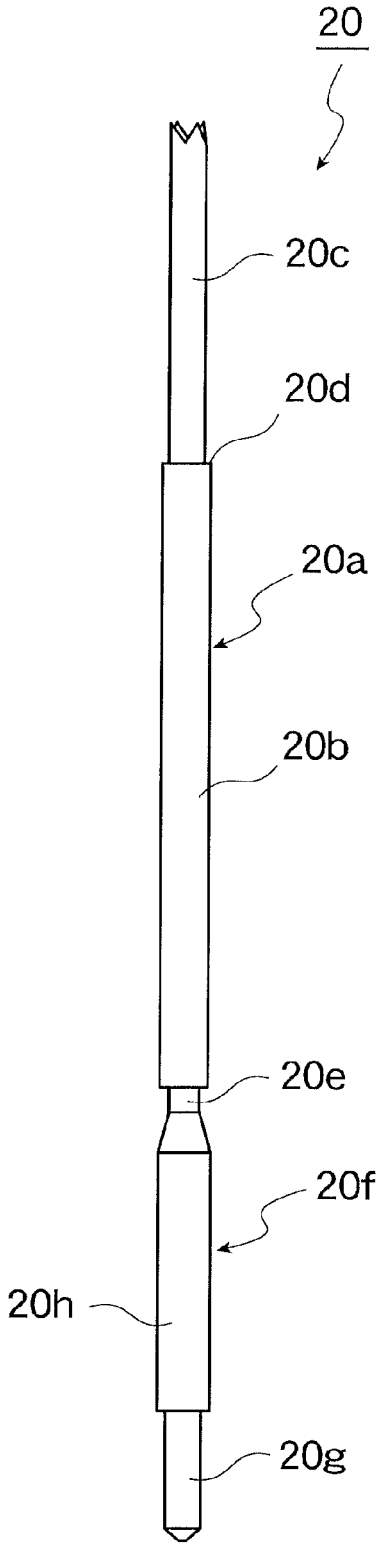
FIG. 3A is an elevation view showing the contact pin after being stroked according to the same embodiment.
Figure 3B:
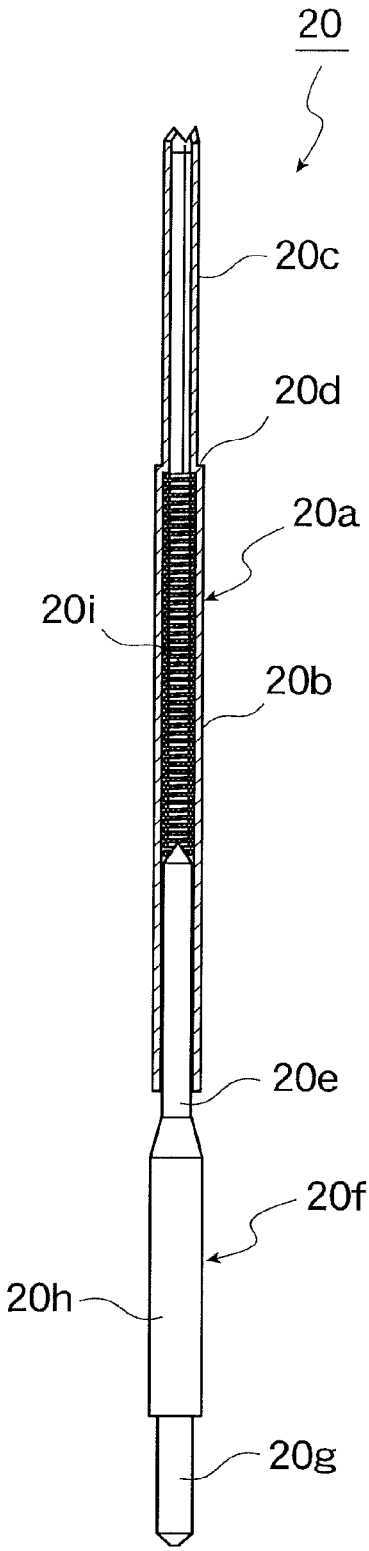
FIG. 3B is a cross-section view showing the contact pin after being stroked according to the same embodiment.

As shown in FIGS. 2A and 2B, each of the contact pins 20 comprises the first plunger 20*a* as the "first contact member", the second plunger 20*f* as the "second contact member" and the coil spring 20*i* as the "urging member". The first plunger 20*a* has conductivity, has cylindrical shape and has a step portion. The second plunger 20*f* has conductivity, has a shape of rod and has a step portion.

The first plunger 20*a* is provided with the external cylinder portion 20*b* having the internal diameter longer than the external diameter of the coil spring 20*i*, the first contact portion 20*c* having the internal diameter shorter than the external diameter of the coil spring 20*i*, and the step portion 20*d* to connect the external cylinder portion 20*b* and the first contact portion 20*c*. The first contact portion 20*c* is made to be contacted with the spherical terminal 12*a* of the IC package 12 (see FIG. 5). The first plunger 20*a* is made by bending a flat conductive plate cylindrically and forming a step. Therefore, it is easy to make contact pins 20 very thin.

The second plunger 20*f* is provided with the body portion 20*h* having the external diameter longer than the internal diameter of the external cylinder portion 20*b* (e.g. 0.27 millimeter) of the first plunger 20*a*, the second contact portion 20*g* having the external diameter shorter than the external diameter of the body portion 20*h* and the internal contact portion 20*e* having the external diameter shorter than the internal diameter of the external cylinder portion 20*b* of the first plunger 20*a*. The internal contact portion 20*e* is inserted into the external cylinder portion 20*b* of the first plunger 20*a* vertically movable. As shown in FIG. 2B, the internal contact portion 20*e* has a taper shape which expands towards the lower end (i.e. the end side the body portion 20*h*) from the upper end (the end of being inserted into the first plunger 20*a*), and so the diameter D2 of the lower end (e.g. 0.24 millimeter) is longer than the diameter D1 of the upper end (e.g. 0.22 millimeter). And the internal contact portion 20*e* is formed so as to contact with the internal surface of the external cylinder portion 20*b* and conduct to it.

The coil spring 20*i* is inserted into the external cylinder portion 20*b* of the first plunger 20*a*. The upper end of the coil spring 20*i* contacts to the step portion 20*d* of the first plunger 20*a*, and the lower end of the coil spring 20*i* contacts to one end of the internal contact portion 20*e* of the second plunger 20*f*. Consequently, the coil spring 20*i* urges the second plunger 20*f* downward.

Next, a way to use the IC socket 11 is described using FIGS. 3 to 7B. Incidentally, as shown in FIG. 2B and so on, the internal contact portion 20*e* according to the present embodiment comprises a sonically-shaped end portion, however, the end portion is omitted in FIGS. 6A to 7B.

Firstly, the IC socket 11 is mounted onto the wiring substrate P. As shown in FIG. 4, before mounting the IC package 12 onto the IC socket 11, the step portions 20*d* of the first plungers 20*a* are engaged with the step portions 20*b* of the through holes 22*a* of the upper side holding member 22, and so the first plungers 20*a* are positioned to the top. In such situation, the second plungers 20*f* contact to the electrodes, which are not shown in Figures, of the wiring substrate P and are pushed upward by the electrodes. The coil springs 20*i*, which are located in the external cylinder portion 20*b* of the first plunger 20*a*, shrink a little in such situation.

Figure 5:
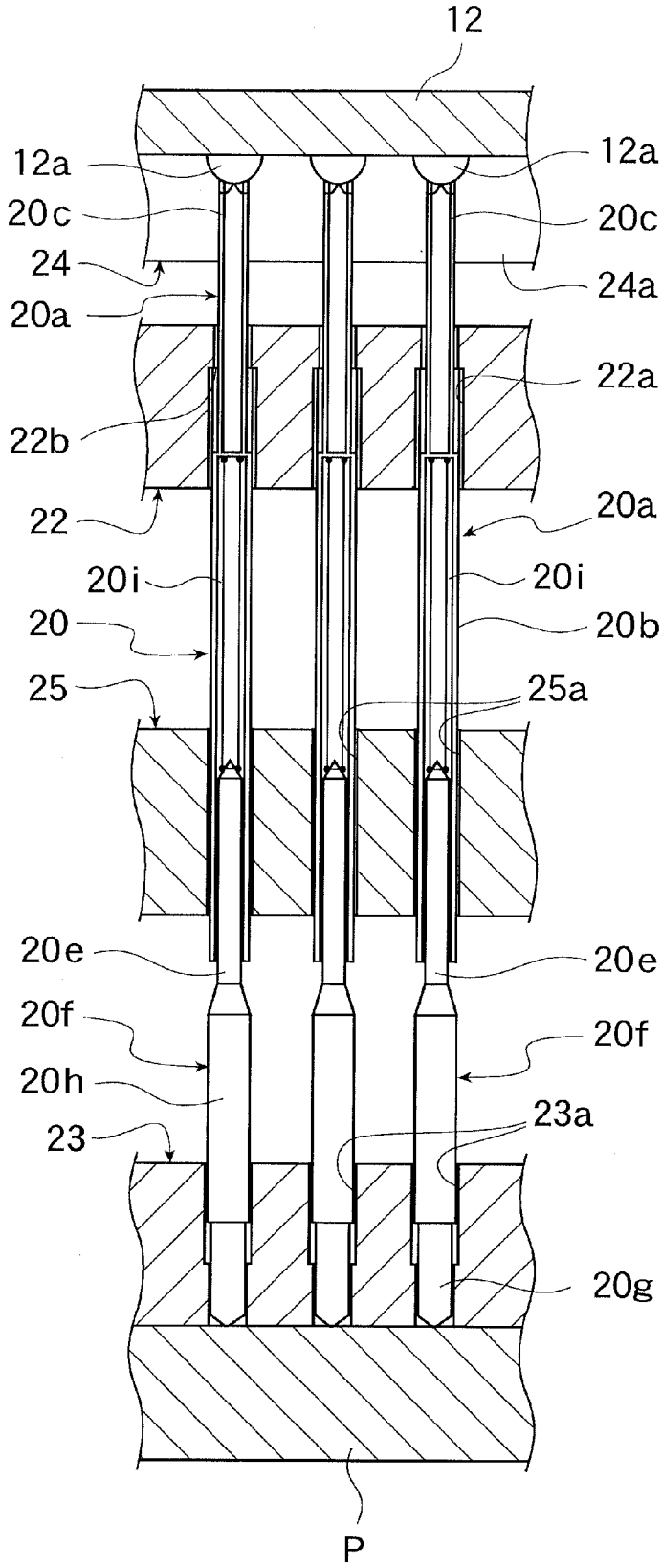
FIG. 5 is a cross-section view showing a state that the IC package is mounted on the IC socket and is pressed downward to give an explanation on how to use the IC socket according to the same embodiment.

When the IC package 12 is mounted onto the IC socket 11 and is pressed downward, the floating plate 24 falls against the urging force of the spring 21, as shown in FIG. 5. Consequently, the spherical terminals 12*a* of the IC package 12 contact to the first contact portions 20*c* of the first plungers 20*a* and push the first plungers 20*a*. As a result, the first plunger 20*a* are pushed downward against the urging force of the coil spring 20*i* (see FIGS. 3A and 3B), and so the internal contact portions 20*e* of the second plungers 20*f* contact with the internal surfaces of the external cylinder portions 20*b* of the first plungers 20*a*, and conduct to them.

Figure 6C:
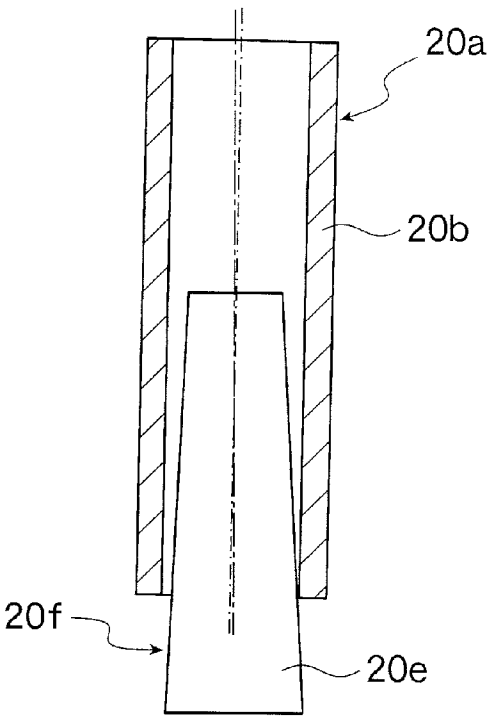
FIGS. 6A to 6C are cross-section pattern diagrams showing a conduction of the contact pin according to the same embodiment.
Figure 6B:
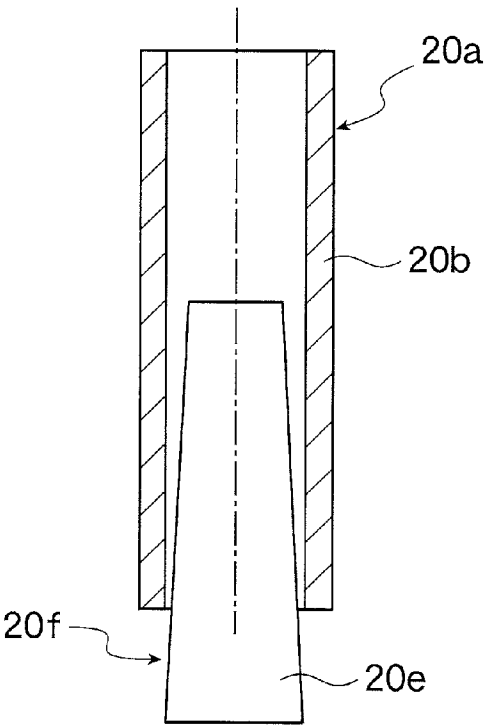
Figure 6A:
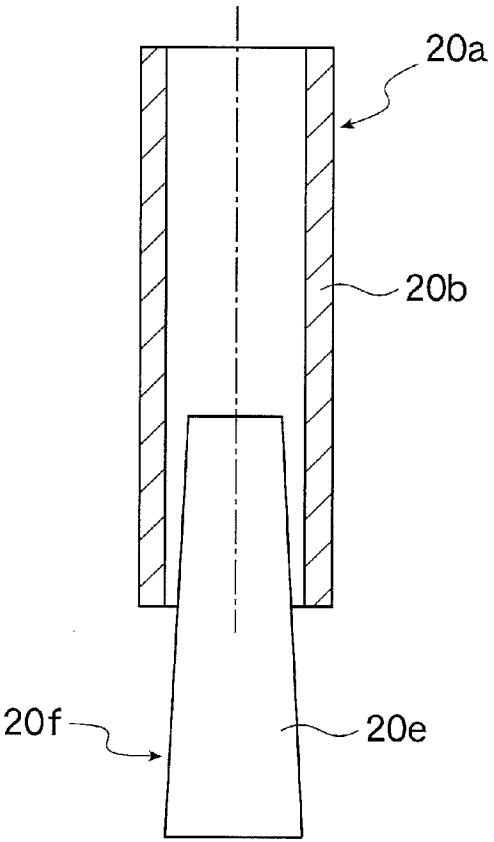

As described above, the internal contact portions 20*e* have taper shapes which expand from the upper end towards the lower end, and so, the distances between the external cylinder portions 20*b* and the internal contact portions 20*e* are very narrow as shown in FIGS. 6A to 6C. Therefore, the external cylinder portions 20*b* and the internal contact portions 20*e* can contact and conduct each other even if the internal contact portions 20*e* lean toward the external cylinder portions 20*b* only a little. As a result, the connection stabilities can be improved without increasing the sliding resistances between the internal contact portions 20*e* and the external cylinder portions 20*b*, even when the amount of reduction in the lengths of the contact pins 20 are small.

Figure 7B:
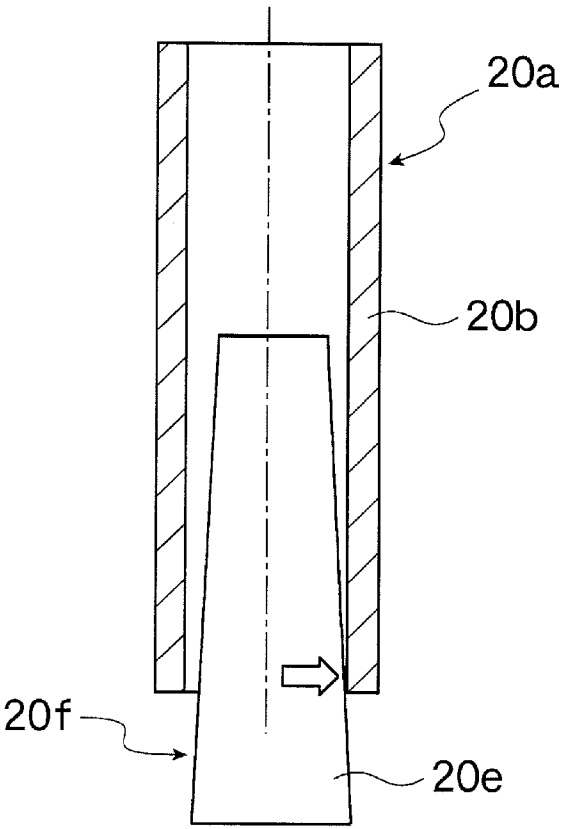
FIGS. 7A and 7B are cross-section pattern diagrams showing a stroke of the contact pin according to the same embodiment.
Figure 7A:
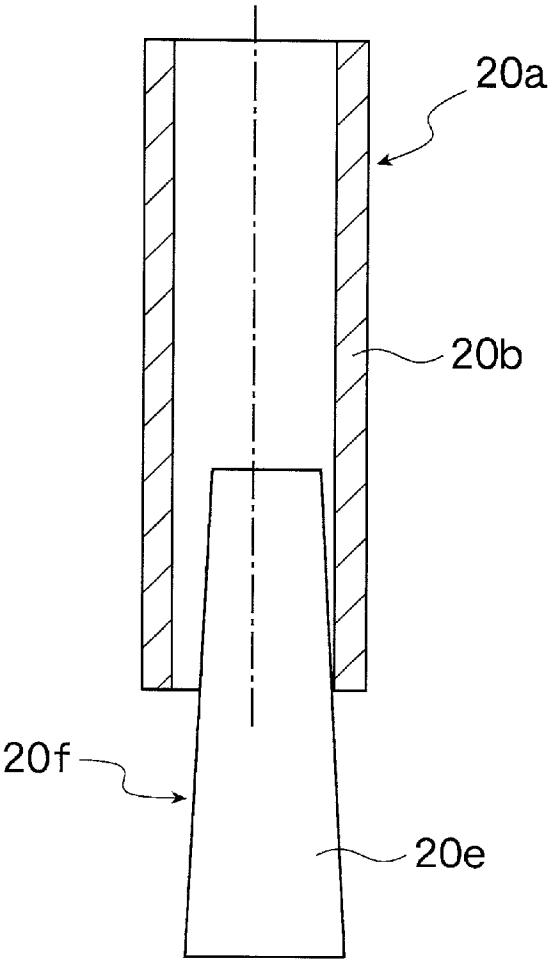

As shown in FIGS. 7A and 7B, the external surfaces of the internal contact portions 20*e* do not become parallel with the internal surfaces of the external cylinder portions 20*b* when the internal contact portions 20*e* are inserted into the external cylinder portions 20*b*, so the lower position of the gaps between these surfaces are narrower. Therefore, the loads of horizontal directions occur at the contact place between the internal contact portions 20*e* and the external cylinder portion 20*b* (see the directing arrow in FIG. 7B), and so the connection stabilities between these portions 20*e* and 20*b* improve.

In this way, the spherical terminals 12*a* of the IC package 12 and the electrodes of the wiring substrate P are electrically connected through the contact pins 20. Then, the electric currents are supplied to the IC package 12 and a burn-in test and so on are performed in such state.

As described above, the present embodiment improves the connection stabilities between the internal contact portions 20*e* and the external cylinder portions 20*b* by devising the forms of the internal contact portions 20*e* of the second plungers 20*f*, and so any special structures of the urging members for separating these portions 20*e* and 20*b* are not required. Therefore, the coil springs 20*i* of simple structures can be used as the urging members.

Incidentally, above mentioned embodiment is used under the state that the cylindrical first plungers 20*a* provided with step portions are positioned at the upper sides and the round-rod-shaped second plungers 20*f* provided with step portions are positioned at the lower sides. However, the electric contact according to the present invention can be used under the state that the second plunger 20*f* is positioned at the upper side and the first plunger 20*a* is positioned at the lower side.

In the case of above mentioned embodiment, the present invention is applied to the IC socket 11 as "socket for electrical part", however, it is clear that the present invention can be applied to other kinds of devices.

Additionally, the present invention can be applied to the IC socket called the "open top type" or the "clam shell type", moreover, can be applied to the test apparatus in which the pusher for pushing the electrical part is located at the side of the automated instrument.

What is claimed is:

1. An electric contact comprising:

a first contact member, having conductivity, and which has an external cylinder portion with an opening end, a second contact member, having conductivity, and which has an internal contact portion to be inserted into the external cylinder portion through the opening end from a first end of the internal contact portion so that the second contact member is thereby interlinked with the first contact member in an extensible manner, and an urging member which, when the internal contact portion is inserted into the external cylinder portion, urges the first contact member and the second contact member toward a direction to separate the first contact member and the second contact member, wherein the internal contact portion has a taper shape which expands from the first end of the internal contact portion toward a second end of the internal contact portion, to thereby provide a taper shape surface of the internal contact portion, and when the internal contact portion is inserted into the external cylinder portion, the internal contact portion moves in the external cylinder portion with the taper shape surface contacting an internal surface of the opening end of the external cylinder portion, so that the internal contact portion thereby conducts with the external cylinder portion as the internal contact portion moves in the external cylinder portion.

2. The electric contact according to claim 1, wherein:

the urging member is a coil spring located inside of the external cylinder portion in an extensible manner, and one end of the coil spring is contacted to one end of the internal contact portion.

3. The electric contact according to claim 2, wherein the first contact member comprises a first contact portion, an inner diameter of which is shorter than a diameter of the coil spring.

4. The electric contact according to claim 3, wherein the other end of the coil spring is contacted to a step portion formed at a connection portion between the external cylinder portion and the first contact portion.

5. A socket for an electrical part, comprising:

a socket body which is located on a wiring substrate and accommodates an electrical part on an upper side thereof, plural electric contacts which are located in the socket body, wherein each electrical contact of the plural electric contacts comprises:

a first contact member, having conductivity, and which has an external cylinder portion with an opening end, a second contact member, having conductivity, and which has an internal contact portion to be inserted into the external cylinder portion through the opening end from a first end of the internal contact position so that the second contact member is thereby interlinked with the first contact member in an extensible manner, and an urging member which, when the internal contact portion is inserted into the external cylinder portion, urges the first contact member and the second contact member toward a direction to separate the first contact member and the second contact member, for each respective electrical contact of the plural electric contacts, when the internal contact portion of the respective electrical contact is inserted into the external cylinder portion of the respective electrical contact, one of the first and second contact members of the respective electrical contact contacts to the electrical part, and the other of the first and second contact members of the respective electrical contact contacts to the wiring substrate, the internal contact portion of the respective electrical contact has a taper shape which expands from the first end of the internal contact portion of the respective electrical contact toward a second end of the internal contact portion of the respective electrical contact, to thereby provide a taper shape surface of the internal contact portion of the respective electrical contact, and when the internal contact portion of the respective electrical contact is inserted into the external cylinder portion of the respective electrical contact, the internal contact portion of the respective electrical contact moves in the external cylinder portion of the respective electrical contact with the taper shape surface contacting an internal surface of the opening end of the external cylinder portion of the respective electrical contact, so that the internal contact portion of the respective electrical contact thereby conducts with the external cylinder portion of the respective electrical contact as the internal contact portion of the respective electrical contact moves in the external cylinder portion of the respectful electrical contact.

6. The socket for an electrical part according to claim 5, wherein:

the urging member is a coil spring located inside of the external cylinder portion in an extensible manner, and one end of the coil spring is contacted to one end of the internal contact portion.

7. The socket for an electrical part according to claim 6, wherein the first contact member comprises a first contact portion, an inner diameter of which is shorter than a diameter of the coil spring.

8. The socket for an electrical part according to claim 7, wherein the other end of the coil spring is contacted to a step portion formed at a connection portion between the external cylinder portion and the first contact portion.

* * * * *